US007677464B1

(12) United States Patent
Donohue

(10) Patent No.: US 7,677,464 B1
(45) Date of Patent: Mar. 16, 2010

(54) SPECIALIZED SPACE CONTROL AND MONITORING SYSTEM

(76) Inventor: Kieran L. Donohue, 8387 N. Indian Creek Pkwy., Fox Point, WI (US) 53217

( * ) Notice: Subject to any disclaimer, the term of this patent is extended or adjusted under 35 U.S.C. 154(b) by 705 days.

(21) Appl. No.: 11/507,326

(22) Filed: Aug. 21, 2006

Related U.S. Application Data

(60) Provisional application No. 60/710,096, filed on Aug. 22, 2005.

(51) Int. Cl.
*G05D 23/275* (2006.01)

(52) U.S. Cl. ..... 236/1 B; 236/44 A; 236/44 C; 165/205; 165/208

(58) Field of Classification Search ..... 165/205, 165/208; 236/1 B, 9 R, 91 E, 94, 44 A, 44 C; 700/277, 227
See application file for complete search history.

(56) References Cited

U.S. PATENT DOCUMENTS 5,156,203 A * 10/1992 Funakoshi et al. ..... 165/207
6,175,782 B1 * 1/2001 Obradovich et al. ..... 236/49.3
2004/0139038 A1 * 7/2004 Ehlers et al. ..... 705/412
2004/0238653 A1 * 12/2004 Alles ..... 236/49.3
2005/0040248 A1 * 2/2005 Wacker et al. ..... 236/51
2005/0270151 A1 * 12/2005 Winick ..... 340/539.1

* cited by examiner

*Primary Examiner*—Frantz F Jules
*Assistant Examiner*—Daniel C Comings
(74) *Attorney, Agent, or Firm*—Donald J. Ersler

(57) ABSTRACT

A specialized space control and monitoring system preferably includes a controller, a software program and a touch screen monitor. The software program is run on the controller. The controller may include a plurality of inputs and outputs for directly monitoring and/or controlling at least one parameter in a room. The plurality of inputs read various sensors. The plurality of outputs are used to actuate control devices for changing various functions. However, the controller could be connected to a facility controller. The touch screen monitor provides access to the software program. The software program preferably includes a selection screen, a parameter display screen, a setpoint screen and a room overview screen.

17 Claims, 7 Drawing Sheets

SPECIALIZED SPACE CONTROL AND MONITORING SYSTEM

CROSS-REFERENCES TO RELATED APPLICATIONS

This is a utility patent application taking priority from provisional application No. 60/710,096 filed on Aug. 22, 2005.

BACKGROUND OF THE INVENTION

1. Field of the Invention

The present invention relates generally to controlling and monitoring environmental parameters in a critical or non-critical room and more specifically to a specialized space control and monitoring system, which allows various environmental factors to be preset for a particular space or room.

2. Discussion of the Prior Art

It appears that the prior art does not disclose a control and monitoring system that allows parameters, such as temperature, humidity and pressure to be preset for a room or space to accommodate the preferences of a particular person, group, room or any other entity through touching a single button. The control and monitoring system with preset parameters eliminates the time and possible error of manually entering parameters for a room or space to accommodate a particular person, group, room or any other entity.

Accordingly, there is a clearly felt need in the art for a specialized space control and monitoring system, which allows various environmental factors to be preset for a specialized space or room and eliminates the potential for error of having to enter data manually for a particular person, group, room or any other entity.

SUMMARY OF THE INVENTION

The present invention provides a specialized space control and monitoring system, which allows various environmental factors to be preset for a particular space or room. The specialized space control and monitoring system (control and monitoring system) preferably includes a controller, a software program and a touch screen monitor. For the purpose of this patent application, the definition of a room includes an enclosure or defined space. The software program is run on the controller.

The controller may include a plurality of inputs and outputs for directly monitoring and/or controlling the parameters in a space or room. The plurality of inputs read various sensors. The plurality of outputs are used to actuate control devices for changing various functions. However, the controller could be connected to a facility controller, which includes the plurality of inputs and outputs. The controller would communicate with the facility controller through standard commercial or industrial protocols.

The touch screen monitor provides access to the software program. The software program preferably includes a room overview screen, a selection screen, a parameter display screen and a setpoint screen. The room overview screen provides the status of each specialized room in a facility. The selection screen provides a selection of a particular person, a particular category or a member of a group by touching a window on a touch screen monitor. The parameter display screen displays parameters in a room, such as environmental parameters and lighting. The setpoint screen allows the parameters to be adjusted by moving a box displayed on the touch screen monitor. The specialized room could be an isolation room, surgical suite, neonatal suite, laboratory, clean room, vivarium room or the like.

Accordingly, it is an object of the present invention to provide a control and monitoring system, which allows various environmental parameters to be preset for a specialized space or room.

Finally, it is another object of the present invention to provide a control and monitoring system, which eliminates the potential for error of having to enter data manually for a particular person, group, room or any other entity.

These and additional objects, advantages, features and benefits of the present invention will become apparent from the following specification.

DETAILED DESCRIPTION OF THE PREFERRED EMBODIMENTS

Figure 1:
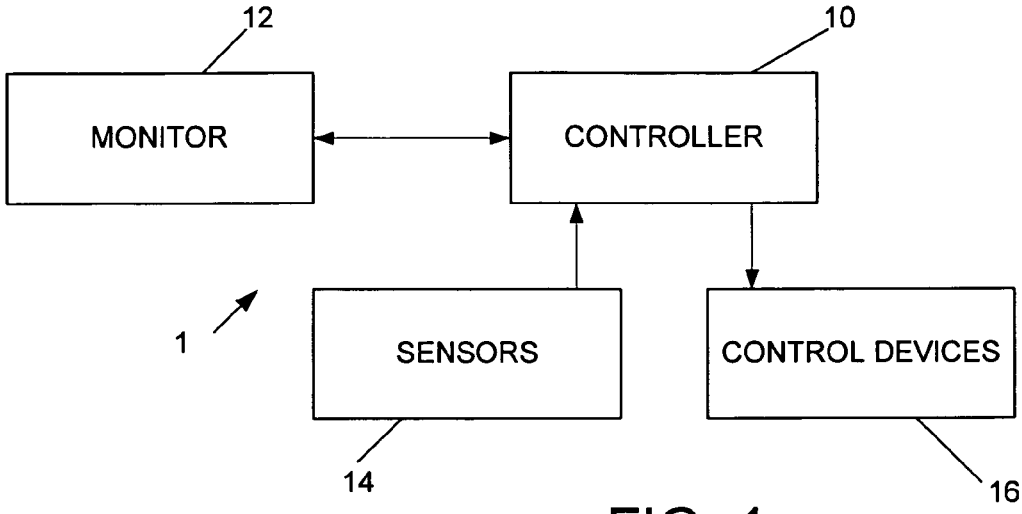
FIG. 1 is a block diagram of a control and monitoring system having a plurality of inputs and outputs in accordance with the present invention.

With reference now to the drawings, and particularly to FIG. 1, there is shown a control and monitoring system 1. The room monitor 1 includes a controller 10, a software program and a touch screen monitor 12. The controller 10 is preferably any suitable microprocessor or microcontroller based controller. The software program is contained in the controller 10. The touch screen monitor 12 allows the entry of data into the software program or programming of the controller 10 through the software program, without the need for a keyboard or keypad.

Figure 1A:
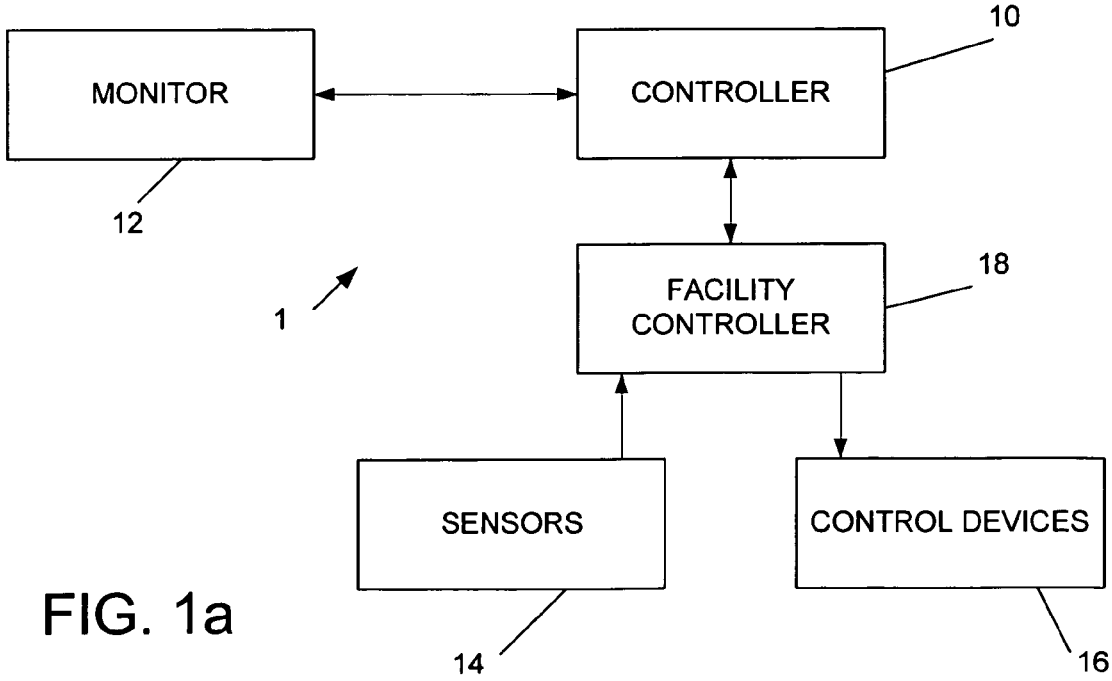
FIG. 1*a* is a block diagram of a control and monitoring system connected to a facility controller in accordance with the present invention.

The controller 10 may include a plurality of inputs and outputs for directly monitoring and/or controlling the parameters in a room, such as pressure, temperature, humidity, lighting, filtering, air quality, air composition and the like. The plurality of inputs read various sensors 14. The plurality of outputs are used to actuate control devices 16 for changing the various parameters. With reference to FIG. 1*a*, the controller could be connected to a facility controller 18, which includes the plurality of inputs and outputs for communication with sensors 14 and control devices 16. The controller 10 would communicate with the facility controller 18 through standard commercial or industrial protocols.

Figure 2:
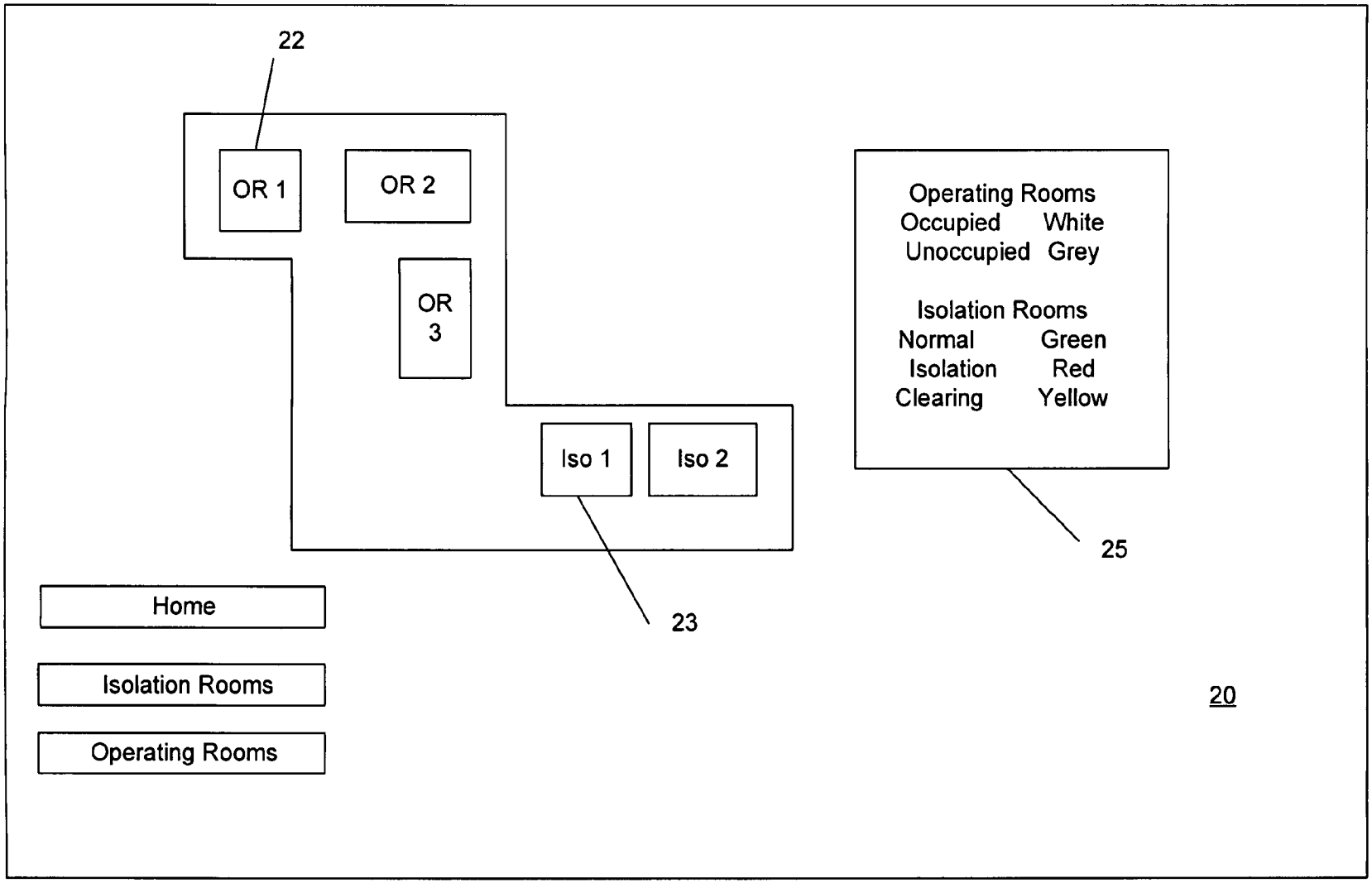
FIG. 2 is a front view of a room overview screen for displaying the status of each specialized room in a facility of a control and monitoring system in accordance with the present invention.

The touch screen monitor 12 provides access to the software program contained in the controller 10. The software program preferably includes a room overview screen, a selection screen, a parameter display screen and a setpoint screen. With reference to FIG. 2, the room overview screen 20 provides the status of each specialized room in a facility. Each room window, such as the OR 1 window 22 preferably has a color code to describe its status. A legend 25 defines the status of each room with a specific color.

Figure 3:
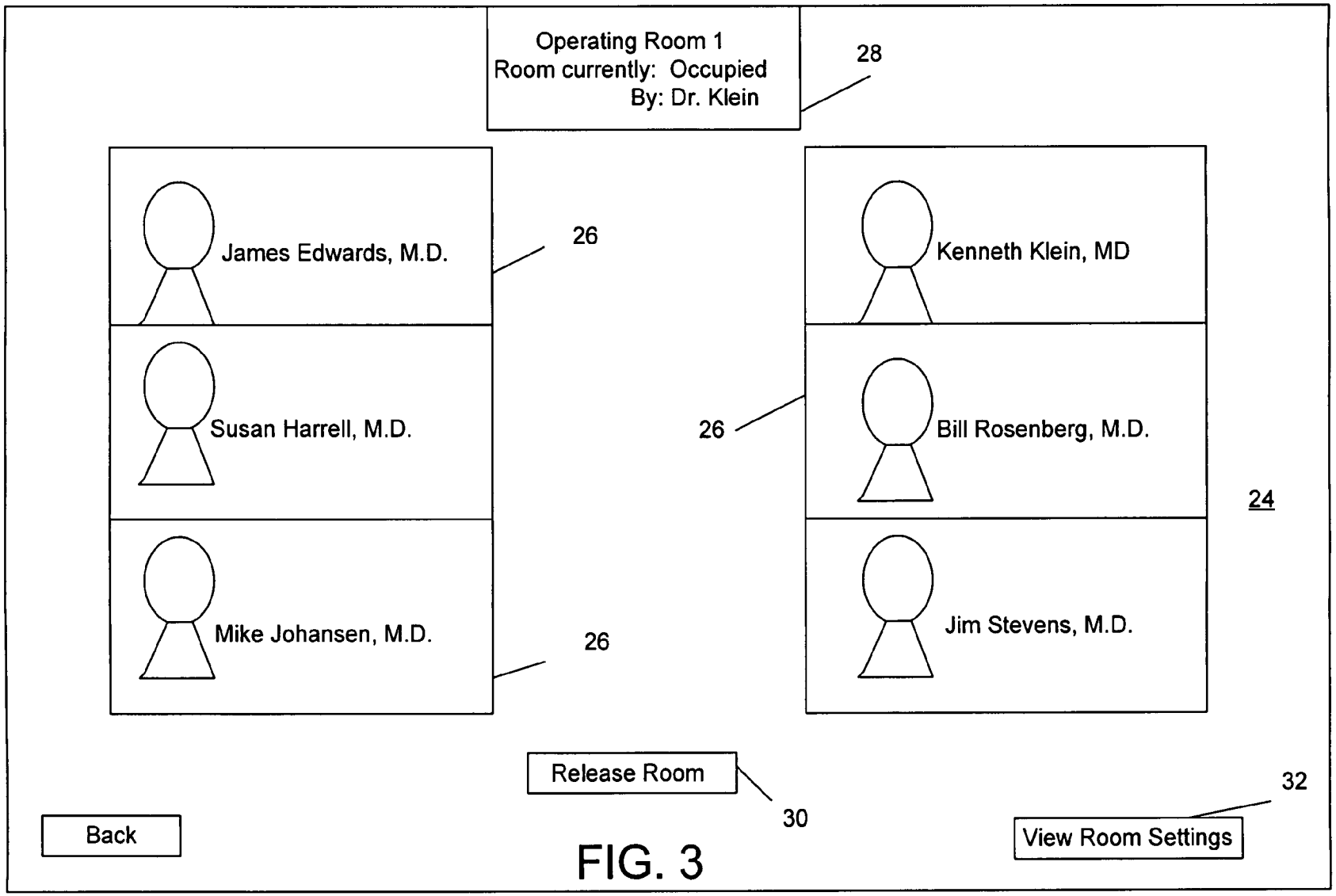
FIG. 3 is a front view of a selection screen that enables room preferences to be obtained for a particular doctor of a control and monitoring system in accordance with the present invention.

With reference to FIG. 3, touching the OR 1 window 22 will provide a doctor selection screen 24. The doctor selection screen 24 includes a doctor window 26 for each doctor, who performs operations in OR 1 (Operating Room 1). A room window 28 displays occupation status and the identity of a doctor in the room. Touching the release room window 30 will change the status of the room from occupied to unoccupied. An unoccupied room will cost less to maintain than an occupied room.

Figure 4:
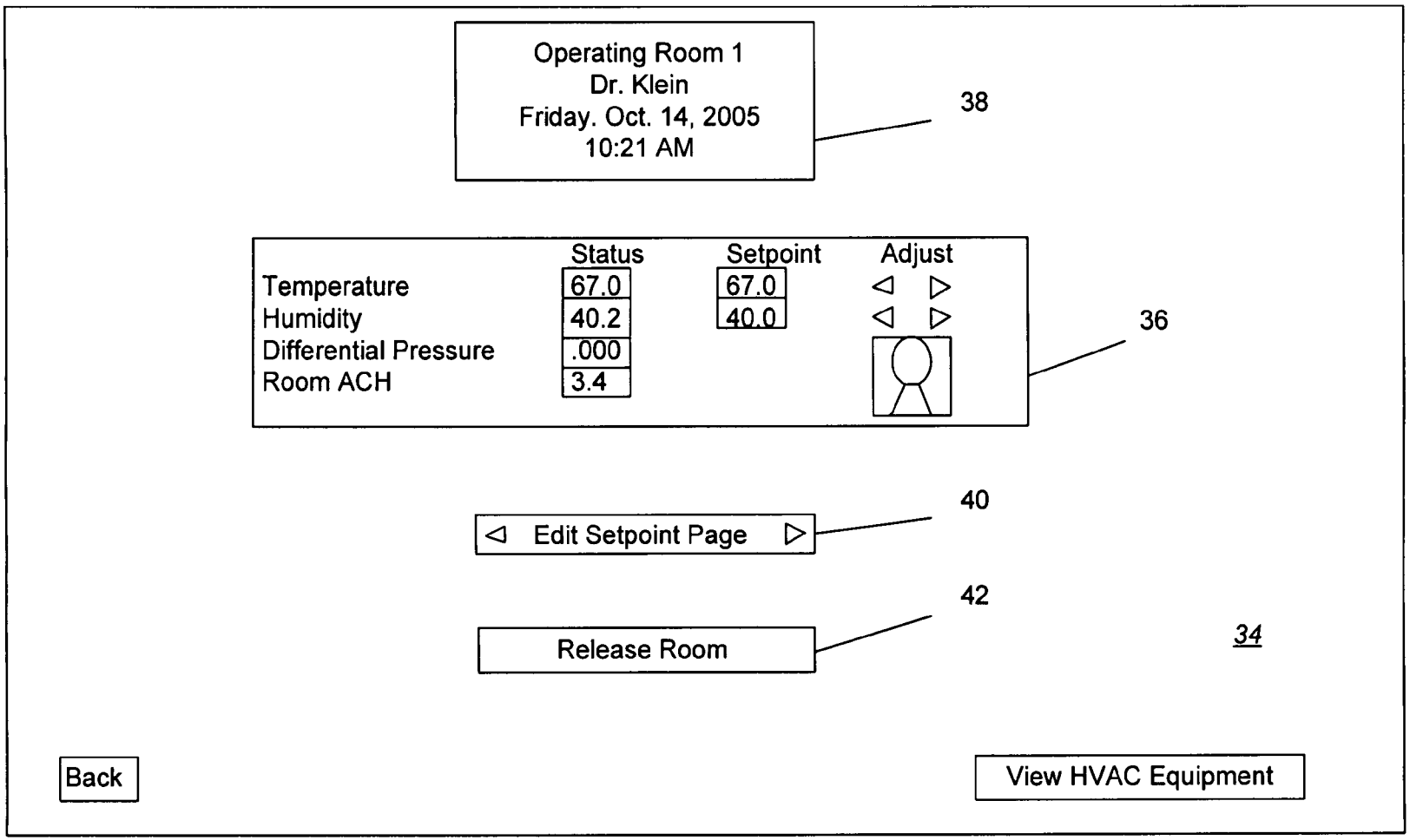
FIG. 4 is a front view of a parameter display screen for displaying characteristics in a room for a particular doctor of a control and monitoring system in accordance with the present invention.

With reference to FIG. 4, touching a view room settings window 32 will provide the parameter display screen 34. The parameter display screen 34 includes a status window 36, a room window 38, a setpoint window 40 and a release room window 42. The status window 36 provides actual readings of temperature, humidity, differential pressure and room ACH. The status window 36 also provides setpoint readings of temperature and humidity. The room window 38 displays occupation status, the identity of a doctor in the room, the time and the date. The release room window 42 changes the status of the room from occupied to unoccupied.

Figure 5:
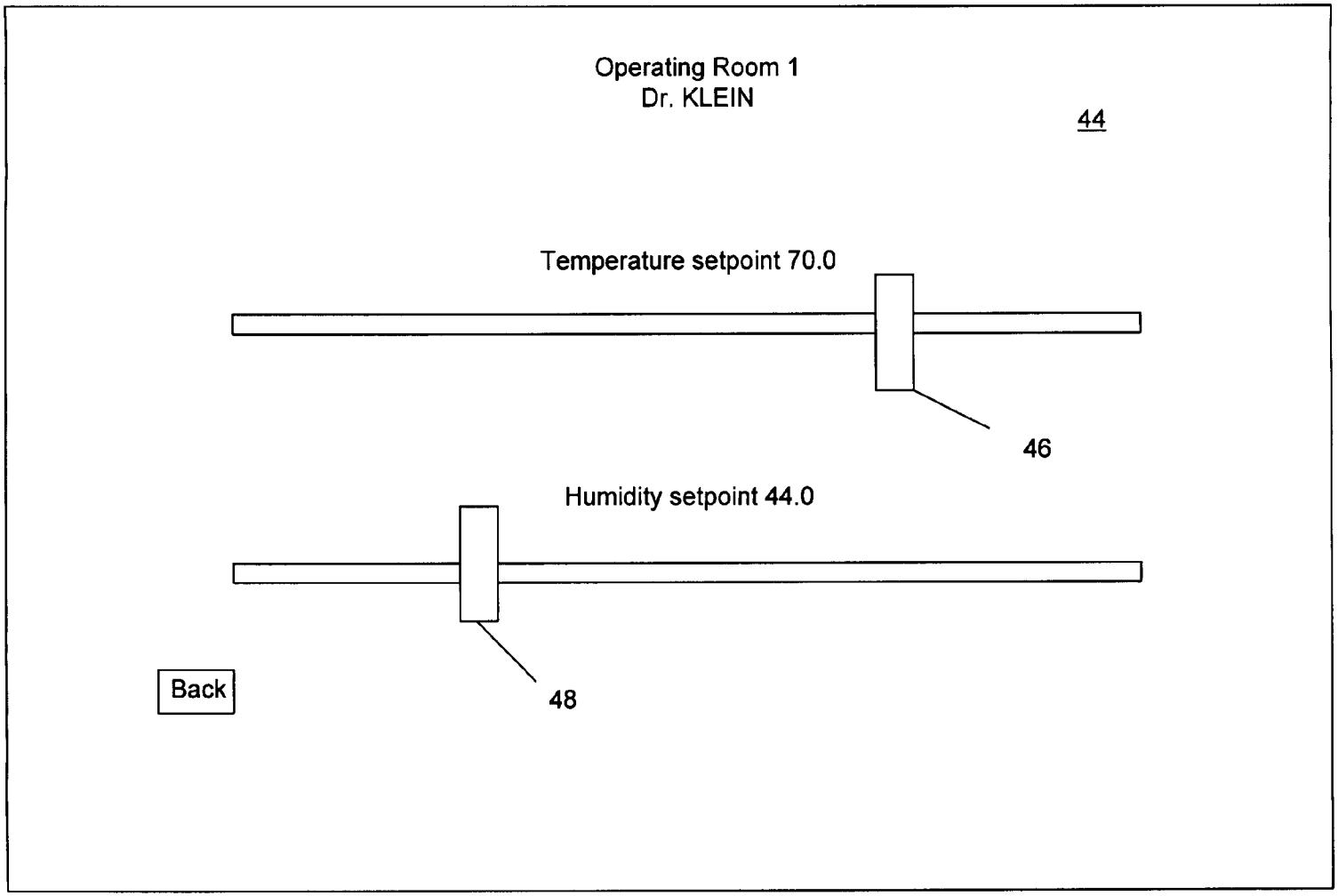
FIG. 5 is a front view of a setpoint screen allows characteristics or parameters in a room to be adjusted for a particular doctor in accordance with the present invention.

With reference to FIG. 5, touching the setpoint window 40 will provide the setpoint screen 44. The setpoint screen 44 includes a temperature setting and a humidity setting. The temperature is set by sliding a temperature box 46 in either direction. The humidity is set by sliding a humidity box 48 in either direction.

Figure 6:
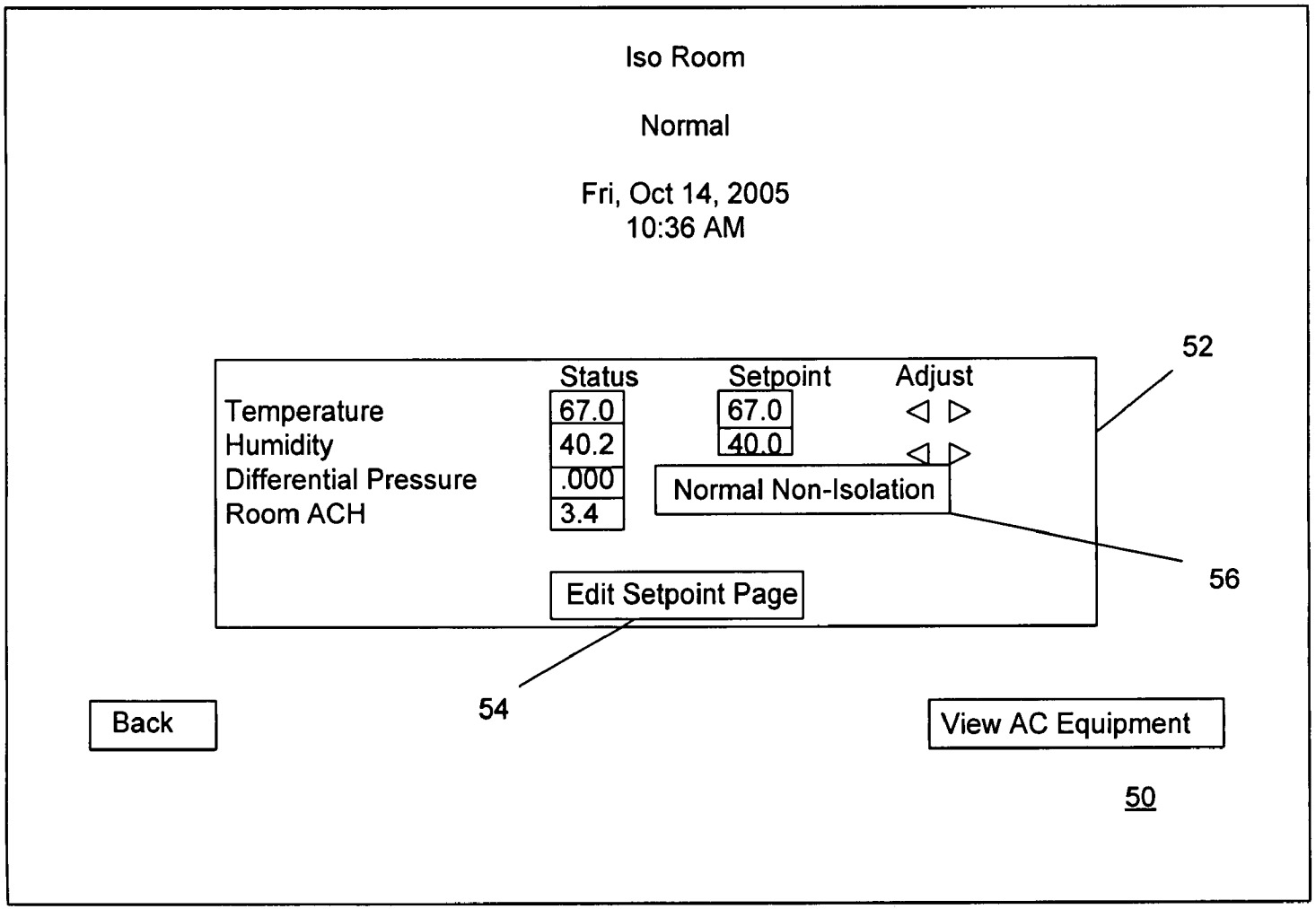
FIG. 6 is a front view of a parameter display screen for displaying characteristics in an isolation room of a control and monitoring system in accordance with the present invention.

With reference to FIG. 6, touching one of the Iso room windows 23 on the room overview screen 20 provides a parameter display screen 50. The parameter display screen 50 includes a status window 52, a setpoint window 54 and a non-isolation window 56. The status window 52 provides actual readings of temperature, humidity, differential pressure and room ACH. The status window 52 also provides setpoint readings of temperature and humidity. The non-isolation window 56 converts the isolation room into a non-isolation room to save the cost of maintaining the isolation room. Touching the setpoint window 54 will provide the setpoint screen 44.

Figure 7:
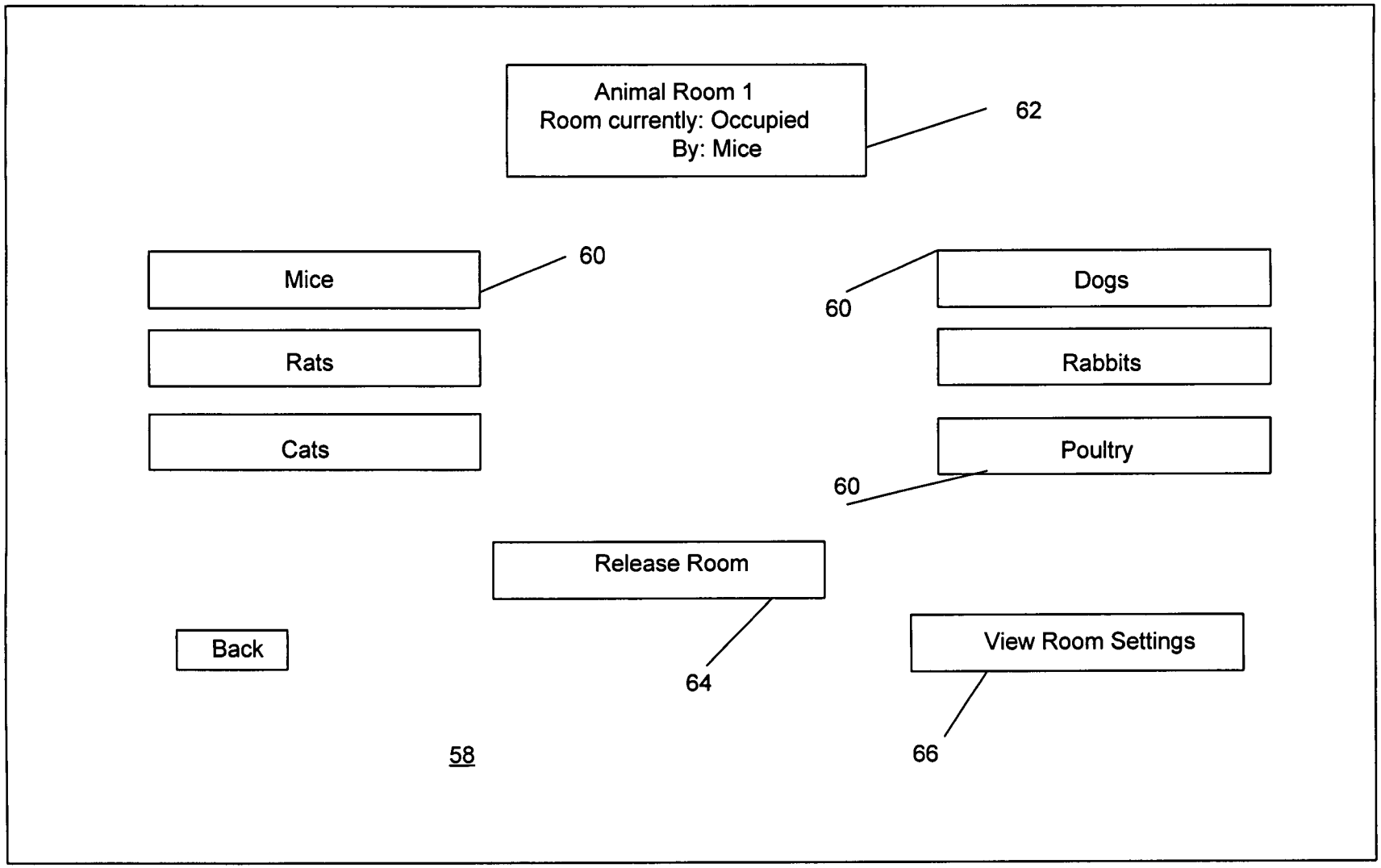
FIG. 7 is a front view of a selection screen that enables room preferences to be obtained for a particular animal of a control and monitoring system in accordance with the present invention.

With reference to FIG. 7, an animal selection screen 58 is similar to the doctor selection screen 24. The animal selection screen 58 includes a plurality of animal windows 60, a room window 62, a release room window 64 and a view room settings window 66. The plurality of animal windows 60 each display the occupation status and the animal in that room. Touching the release room window 64 will change the status of the room from isolated to non-isolated. Touching the view room settings window 66 will provide a screen similar to the parameter display screen 34.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A control and monitoring system comprising:

a controller having a software program, said software program including a selection screen, said selection screen providing a choice of one medical professional from a plurality of medical professionals, a choice of setting at least one parameter of pressure, temperature, humidity and lighting for a specialized space, said specialized space and said at least one parameter being displayed on the same screen as a name of said one medical professional, the choice of said at least one parameter being stored in said controller for said one medical professional;

a monitor being connected to said controller, said monitor being contacted to provide said choice of said one medical professional; and a graphical representation of said one medical professional being displayed adjacent said name of said one medical professional.

2. The control and monitoring system of claim 1, further comprising:

a setpoint screen for setting the at least one parameter for said one medical professional.

3. The control and monitoring system of claim 1, further comprising:

a room overview screen providing the status of each specialized room in a facility.

4. The control and monitoring system of claim 1 wherein:

said controller has a plurality of inputs connected to a plurality of sensors and a plurality of outputs connected to a plurality of control devices.

5. The control and monitoring system of claim 1, further comprising:

said controller being connected to a facility controller, said facility controller having a plurality of inputs connected to a plurality of sensors and a plurality of outputs connected to a plurality of control devices.

6. The control and monitoring system of claim 5 wherein:

said controller communicates with said facility controller through one of a standard commercial protocol and a standard industrial protocol.

7. The control and monitoring system of claim 1, further comprising:

said specialized space being one of an operating room and an isolation room.

8. A control and monitoring system comprising:

a controller having a software program, said software program including a selection screen, said selection screen providing a choice of one medical professional from a plurality of medical professionals, a choice of a specialized space being one of an operating room and an isolation room for said one medical professional, a choice of setting at least one parameter of air filtering, air quality and air composition for said specialized space, said specialized space and said at least one parameter being displayed on the same screen as a name of said one medical professional, the choice of said at least one specialized space and said at least one parameter being associated with and stored in said controller for said one medical professional;

a graphical representation of said one medical professional being displayed adjacent said name of said one medical professional; and a touch screen monitor being connected to said controller, said touch screen monitor being contacted to provide said choice of said one medical professional.

9. The control and monitoring system of claim 8, further comprising:

a setpoint screen for setting the at least one parameter for said one medical professional.

10. The control and monitoring system of claim 8, further comprising:

a room overview screen providing the status of each specialized room in a facility.

11. The control and monitoring system of claim 8 wherein:

said controller has a plurality of inputs connected to a plurality of sensors and a plurality of outputs connected to a plurality of control devices.

12. The control and monitoring system of claim 8, further comprising:

said controller being connected to a facility controller, said facility controller having a plurality of inputs connected to a plurality of sensors and a plurality of outputs connected to a plurality of control devices.

13. The control and monitoring system of claim 12 wherein:

said controller communicates with said facility controller through one of a standard commercial protocol and a standard industrial protocol.

14. A control and monitoring system comprising:

a controller having a software program, said software program including a selection screen, said selection screen providing a choice of one animal from a plurality of different animal types, a choice of setting at least one parameter of pressure, temperature, humidity and lighting for a specialized space, said specialized space and said at least one parameter being displayed on the same screen as a name of said one animal, said specialized space being occupied by said one animal, the choice of said at least one parameter being associated with and stored in said controller for said one animal;

a graphical representation of said one animal being displayed adjacent said name of said one animal; and a touch screen monitor being connected to said controller, said touch screen monitor being contacted to provide said choice of said one animal from said plurality of different animal types.

15. The control and monitoring system of claim 14, further comprising:

a room overview screen providing the status of each specialized room in a facility.

16. The control and monitoring system of claim 14 wherein:

said controller has a plurality of inputs connected to a plurality of sensors and a plurality of outputs connected to a plurality of control devices.

17. The control and monitoring system of claim 14, further comprising:

said controller being connected to a facility controller, said facility controller having a plurality of inputs connected to a plurality of sensors and a plurality of outputs connected to a plurality of control devices.

* * * * *